United States Patent [19]

Mecklenburg

[11] 4,087,944

[45] May 9, 1978

[54] MOVABLE PARTITION ARRANGEMENT

[75] Inventor: Günther Mecklenburg, Troisdorf, Germany

[73] Assignee: Dynamit Nobel Aktiengesellschaft, Germany

[21] Appl. No.: 495,055

[22] Filed: Aug. 5, 1974

[30] Foreign Application Priority Data

Aug. 3, 1973 Germany ..... 2339334

[51] Int. Cl.[2] ..... E04B 2/32

[52] U.S. Cl. ..... 52/241; 52/36; 52/242; 52/275; 52/281; 52/479; 52/481; 52/496; 52/586

[58] Field of Search ..... 52/479, 241, 481, 407, 52/492, 36, 590, 71, 586, 242, 582, 275, 403, 281, 286

[56] References Cited

U.S. PATENT DOCUMENTS

| | | | |
|---|---|---|---|
| 1,890,954 | 12/1932 | Snyder | 52/586 X |
| 2,000,243 | 5/1935 | Manske | 52/479 X |
| 2,100,238 | 11/1937 | Burgess | 52/393 |
| 2,225,612 | 12/1940 | Allen | 52/586 |
| 2,325,694 | 8/1943 | Marshall | 52/241 |
| 2,627,949 | 2/1953 | Willson | 52/403 X |
| 2,667,241 | 1/1954 | Shannon | 52/281 X |
| 2,846,167 | 8/1958 | Walsh | 52/586 X |
| 3,027,605 | 4/1962 | Nelsson | 52/242 X |
| 3,160,249 | 12/1964 | Pavlecka | 52/586 |
| 3,174,592 | 3/1965 | Berman et al. | 52/479 |
| 3,206,805 | 9/1965 | Steenhagen | 52/408 X |
| 3,217,452 | 11/1965 | Steele | 52/241 X |
| 3,228,158 | 1/1966 | Russell | 52/586 |
| 3,258,890 | 7/1966 | Dirkse | 52/397 X |
| 3,332,190 | 7/1967 | Ekstrom | 52/281 X |
| 3,368,312 | 2/1968 | Shore | 52/241 |
| 3,572,224 | 3/1971 | Perry | 52/586 |
| 3,605,363 | 9/1971 | Bard | 52/241 X |
| 3,611,653 | 10/1971 | Zinn | 52/407 X |
| 3,729,889 | 5/1973 | Baruzzini | 52/403 X |
| 3,861,103 | 1/1975 | Rasmussen | 52/241 |

FOREIGN PATENT DOCUMENTS

| | | | |
|---|---|---|---|
| 690,475 | 7/1964 | Canada | 52/393 |
| 1,227,791 | 8/1960 | France | 52/586 |
| 1,345,731 | 11/1963 | France | 52/241 |
| 2,120,445 | 5/1972 | Germany | 52/241 |
| 577,543 | 5/1946 | United Kingdom | 52/586 |
| 499,693 | 1/1939 | United Kingdom | 52/393 |

*Primary Examiner*—Leslie Braun
*Attorney, Agent, or Firm*—Craig & Antonelli

[57] ABSTRACT

A movable multi-panel partition arrangement wherein mounting elements are provided on the ceiling, the floor, and lateral walls of a room to which the panels of the partition arrangement are secured. Tubular connecting elements are provided and employed to interconnect adjacent panels of the partition arrangement. The tubular elements are of various configurations and are received in recesses provided in adjacent edges of the respective panels. Sound absorbing material may be disposed between the panels and light strips, windows, doors, or other installations may be connected to the partition arrangement by further connecting members.

6 Claims, 34 Drawing Figures

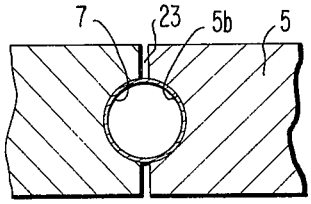
FIG. 1a
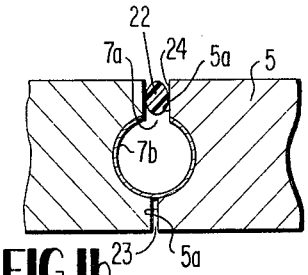
FIG. 1b
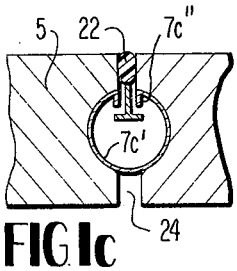
FIG. 1c
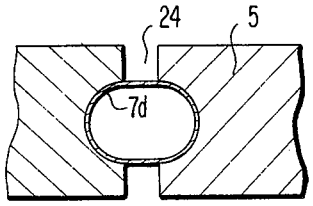
FIG. 1d
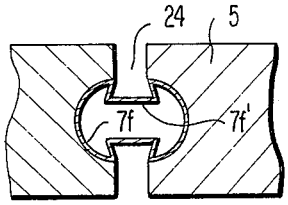
FIG. 1f
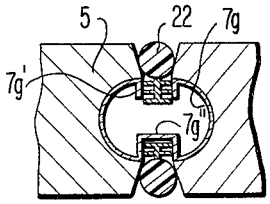
FIG. 1g
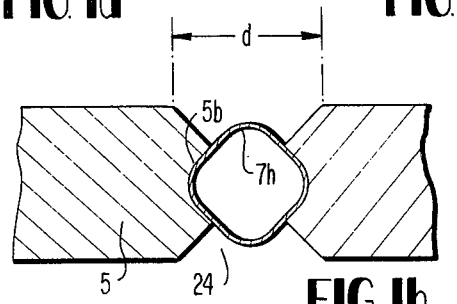
FIG. 1h
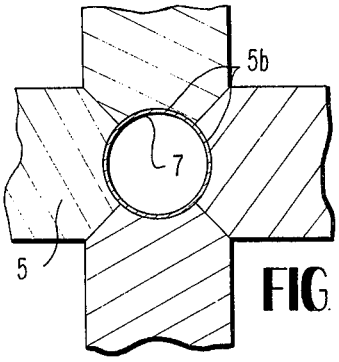
FIG. 1i
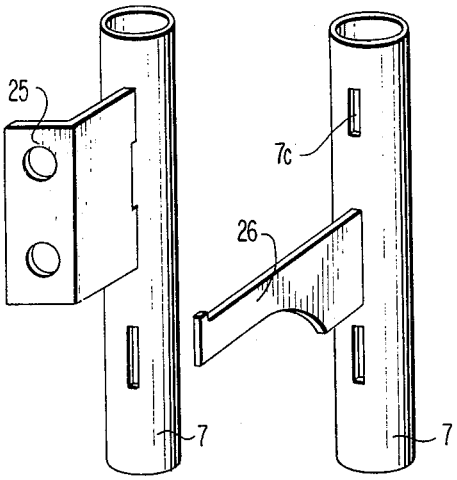
FIG. 2a
FIG. 2b
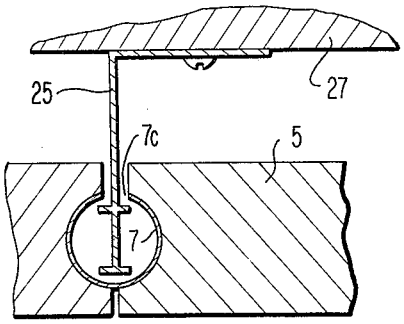
FIG. 2c FIG. IIa
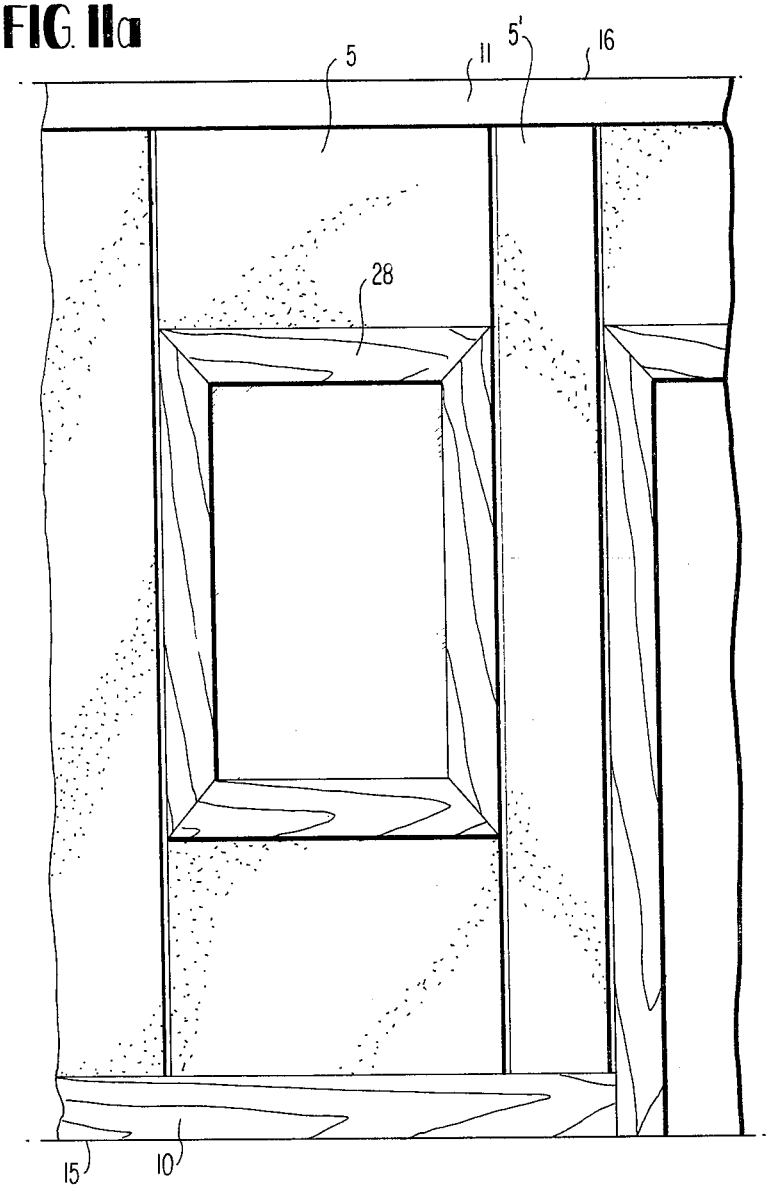
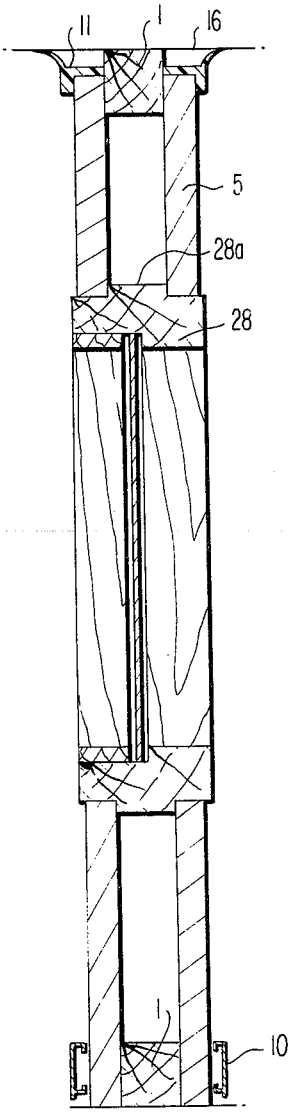
FIG. IIb
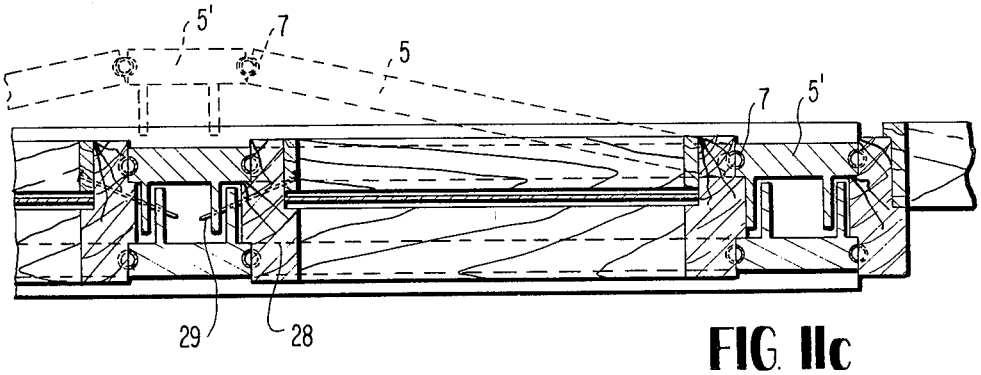
FIG. IIc FIG. 12a
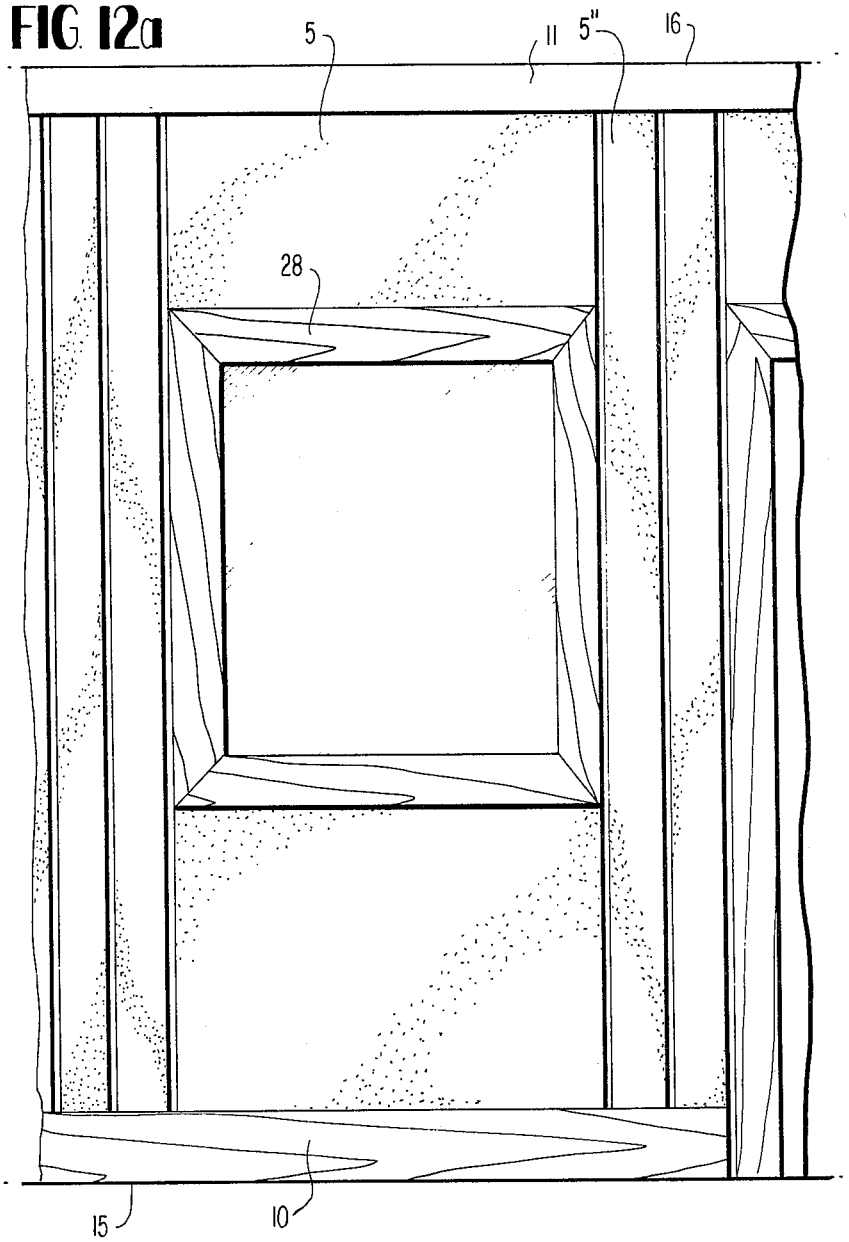
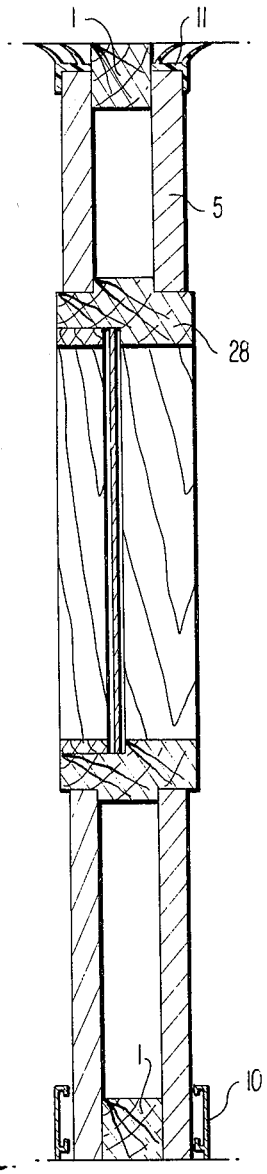
FIG. 12b
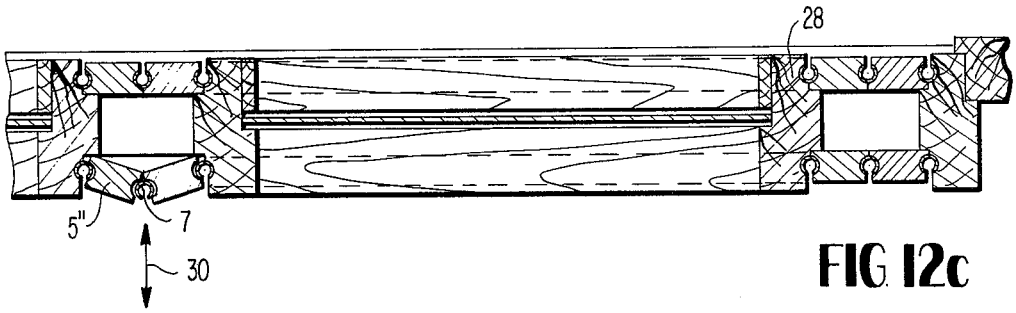
FIG. 12c

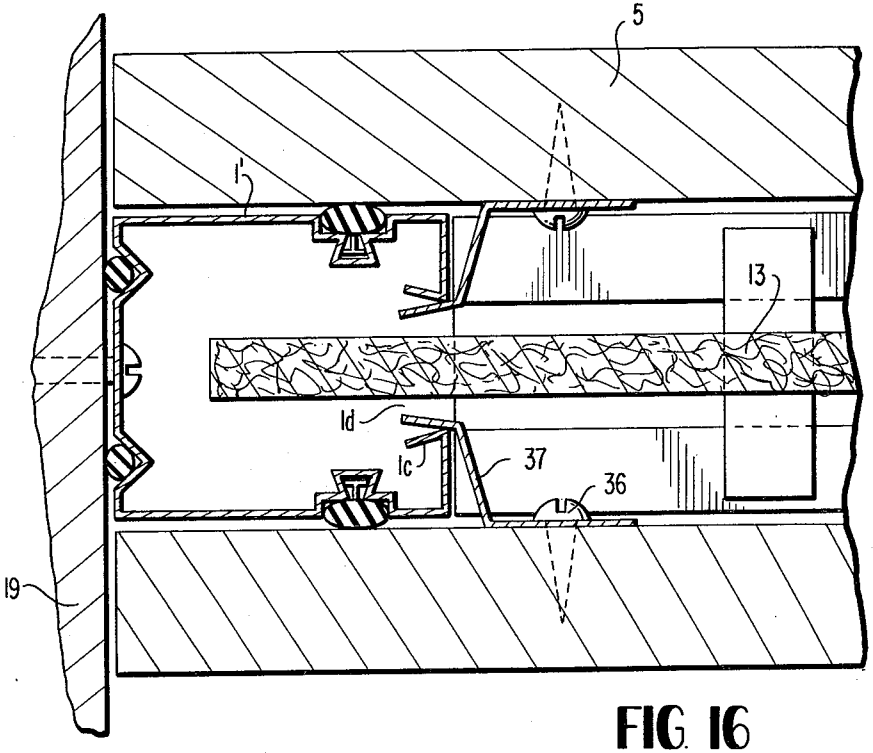
FIG. 16
FIG. 15
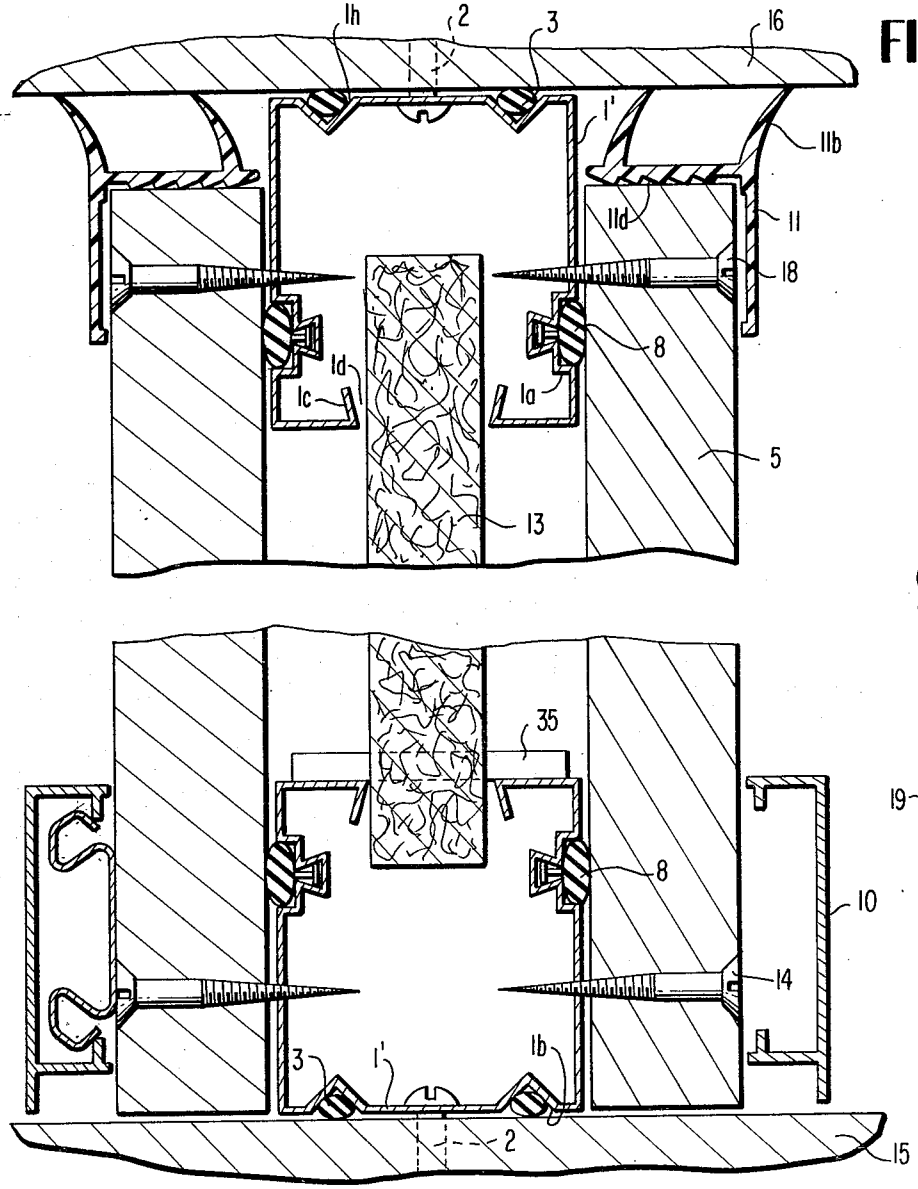

MOVABLE PARTITION ARRANGEMENT

The present invention relates to a multi-wall or multi-panel partition made up of individual elements, especially for interior design, with mounting elements arranged on the floor of the room, the lateral room walls, and at the room ceiling.

Conventional displaceable partition systems are normally provided with a support system wherein posts or supporting columns are attached at selected intervals to the floor and ceiling with the wall elements being thereafter inserted and attached thereto. In these conventional systems, the posts serve as connecting members of the walls or shells which make up the partition member.

The provision of posts or supporting columns attached at intervals along the floor and ceiling result in a partition system which is extremely difficult to assemble and disassemble and, additionally, is expensive to manufacture.

Accordingly, it is an object of the present invention to provide a partition arrangement which avoids the shortcomings and drawbacks encountered in the prior art.

A further object of the present invention resides in providing a multi-wall partition arrangement which may be assembled according to the building block principle.

A still further object of the present invention resides in providing a partition arrangement which is portable and has a minimum number of components thereby rendering the same readily erectable and removable.

Another object of the present invention resides in providing a partition arrangement which has maximum versatility in its use and exhibits good sound attenuation.

According to one feature of the present invention, in a twowall or two-panel partition arrangement, the front edges of the wall elements are formed with continuous recesses along vertically extending butt joints with adjacent wall panel assemblies being movably connected with each other by means of tubular coupling members.

According to the present invention, a partition arrangement is realized without the support system required in prior art construction for connecting the walls or panels with one another. In a two-wall or two-panel partition arrangement according to the present invention the coupling members take over the articulating function and the butt joint zone and serve simultaneously for the static rigidification of the walls of the partition arrangement.

The present invention provides a construction whereby a simple assembly and disassembly of the partition arrangement is made possible since it is merely necessary to attach the wall or panel element, after erection, in the floor and ceiling zones.

According to a further feature of the present invention the tubular coupling member is fashioned with cross-sectional dimensions which, at least in the direction of the wall or panel thickness of the wall or panel elements, are smaller than the wall or panel thickness of the wall or panel elements.

According to still another feature of the present invention, mutually identical connecting strips are provided on the floor and at the ceiling of the room with the wall or panel elements contacting these strips and being attached thereto. The connecting strips form an abutmennt for the wall or panel elements to be set up. The wall or panel elements are somewhat shorter than the height of the room and a ceiling strip is inserted between the ceiling of the room and the upper edge of the wall or panel element. The ceiling strip serves simultaneously as a decorative molding and as a sealing strip which can be fashioned as a sound-damping component.

The connecting strips according to the present invention are formed, along their respective sides contacting the room parts and the wall or panel elements, with recesses for receiving elastic sealing means whereby a certain compensation for dimensional inaccuracies of the walls or panels is possible and sound-damping is improved by the interruption of the sound-conducting bridges.

Additionally, the connecting strips can be constructed to be solid, for example of wood, or, for example, as an approximately U-shaped hollow profile of metal wherein the recesses for the reception of the sealing means have already been incoporated into the profile contour.

According to a further feature of the present invention, to connect the wall elements of the partition arrangement to the lateral walls of the room, the same connecting strip as used for the ceiling or floor connections may be employed; however, a formed wall connection strip can also be employed the width of which corresponds to the thickness of the partition arrangement. Furthermore, the formed wall connection strip can be formed, in the zone of the butt joint with a respective wall or panel element, with recesses for receiving the tubular coupling member. By this construction a wall connection strip is provided which makes it especially easy to extend and erect the partition arrangement in the lateral region while at the same time insuring a tight junction with the wall of a room. Also, such construction may be provided with a further recess for receiving elastic sealing means in the zone of the sides contacting the wall of the room and the sides contacting the end faces of the wall elements in order to insure a tight connection and a satisfactory sound damping effect.

To improve the sound deadening effect in the zone of the tubular coupling members, a further feature of the present invention resides in providing the recesses in the longitudinal edges of the wall or panel elements with an additional receding concavity in which an elastic seal is inserted. The tubular coupling member may have an oval, rounded or circular section and may be formed with a continuous longitudinal slot to provide a certain resilient elasticity and an interruption of the sound-conducting bridge presented by the closed tube configuration. Moreover, gaskets, decorative moldings, cover strips, hooks, or the like may be inserted into the longitudinal slot of the tubular coupling member.

According to a further feature of the present invention, the front edges of the wall or panel element are set back in addition to the recesses provided in the wall or panel elements on one side or both sides thereof whereby an enlarged butt joint can be formed on one or both sides of the partition arrangement during the assembly of the wall or panel elements. The increased butt joint facilitates the installation of the wall or panel elements and offers the possibility of mounting an additional sound-absorbing component, sealing means, decorative molding, or the like therein.

To further improve the sound damping effect, the present invention proposes the installation of sound-absorbing mats or the like in the interstice remaining between the two wall or panel elements of the partition arrangement. This interstice also serves for receiving installations, cables, pipes, etc.

Additionally, the two-wall or two-panel partition arrangement of the present invention can be supplemented by further components, such as, for example, transparent texturized plastic panels for lighting strips, H-shaped intermediate members for the reception of smaller wall or panel elements than the wall or panel elements normally employed, base rails, etc., so that a two-wall or two-panel sound-insulating partition arrangement can be erected which corresponds to diversified requirements and which can be disassembled as easily as assembled.

To facilitate the fastening of baseboards to the partition arrangement, the present invention proposes the providing of clips or the like whereby the baseboards may readily be snapped into position. Consequently, the sub-constructions for the baseboard and sealing strip normally provided for in the prior art constructions are eliminated since these elements can advantageously be included in the structure of the wall or panel elements.

According to yet another feature of the present invention, the tubular coupling elements may be employed to couple a partition arrangement wherein a single wall or panel element is employed with the tubular coupling members being joined by webs or tongues to achieve a high stability.

An advantage of the present invention resides in the provision of a partition arrangement which no longer includes an actual supporting system for connecting the walls or panels of the partition arrangement with each other but rather has only a common frame formed from the floor, ceiling and wall connecting strips.

A further advantage of the present invention resides in the fact that the walls or panels of the partition arrangement each are joined by means of tubular coupling members which, in the vertical joint and seam zone, have the effect of a tubular joint in addition to simultaneously acting as a static rigidification or reinforcement of the partition arrangement.

Since it has heretofore been impossible in conventional partition systems to close the partition under tension, a further advantage of the present invention resides in the fact that the rotating insertion of the wall or panel elements during assembly requires only a very slight pressure and ensures a high fitting accuracy.

These and other objects, features, and advantges of the present invention will become more obvious from the following description when taken in connection with the accompanying drawings which show, for the purposes of illustration only, several embodiments of the partition arrangement in accordance with the present invention, and wherein:

FIGS. 1*a*–1*d* and 1*f*–1*i* are cross sectional views of tubular coupling members in accordance with the present invention;

FIGS. 2*a* and 2*b* are perspective views of tubular coupling members having slots therein for receiving additional attachments;

FIG. 2*c* is a partial cross sectional view of the tubular cross member of FIG. 2*a* with an attachment secured thereon;

FIG. 11*a* is a plan view of a partition arrangement according to the present invention with a window installation provided therein;

FIGS. 11*b* and 11*c* are cross sectional views of the arrangement of FIG. 11*a;*

FIG. 12*a* is a plan view of a further embodiment of the present invention illustrating a further connection for a window or door;

FIGS. 12*b* and 12*c* are cross-sectional view of the arrangement of FIG. 12*a;*

Figure 13:
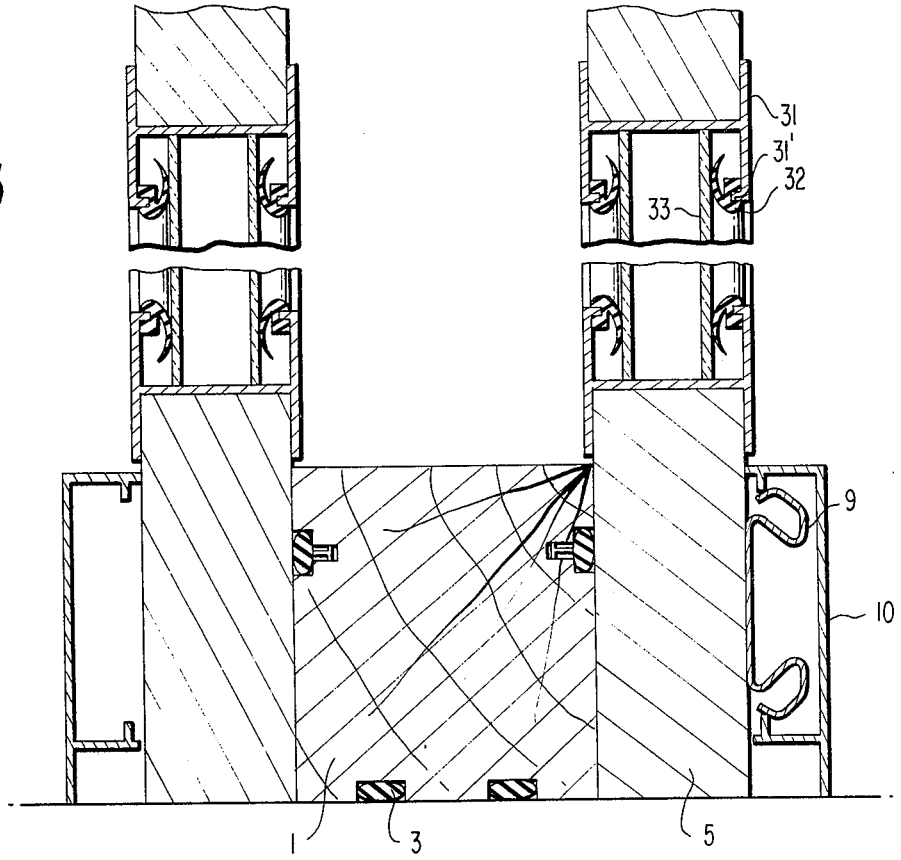
Figure 14:
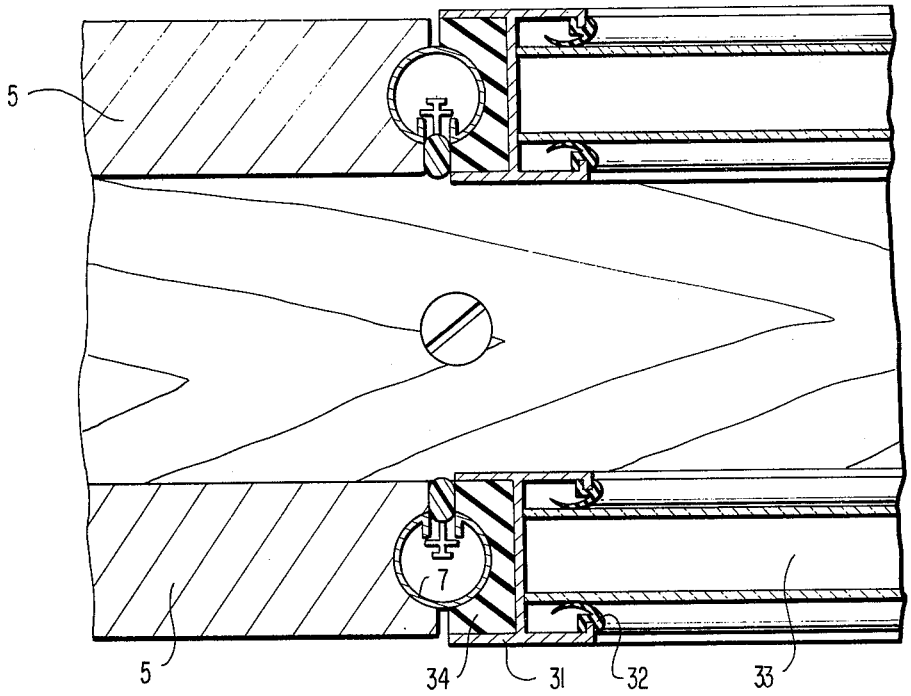
Figure 17:
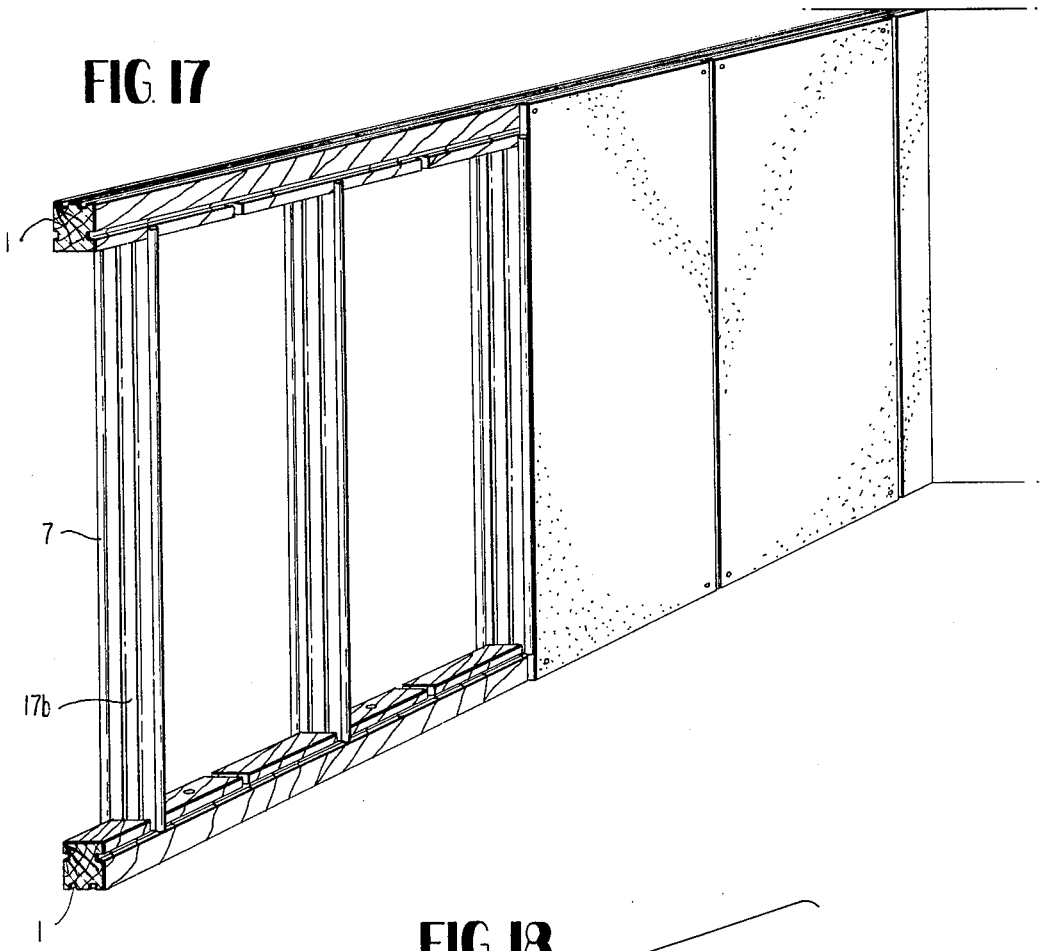
Figure 18:
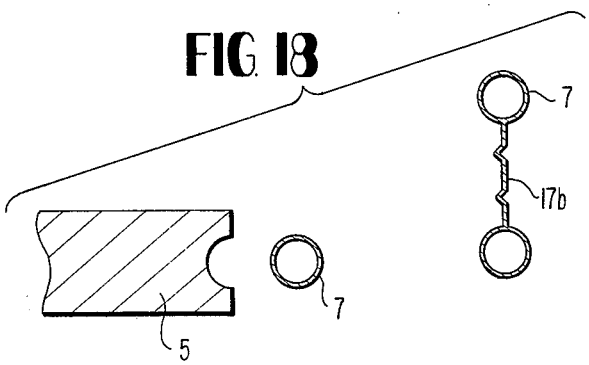
Figure 19:
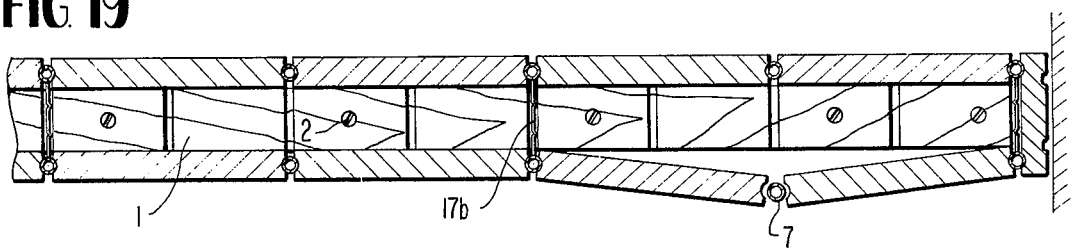
Figure 20:
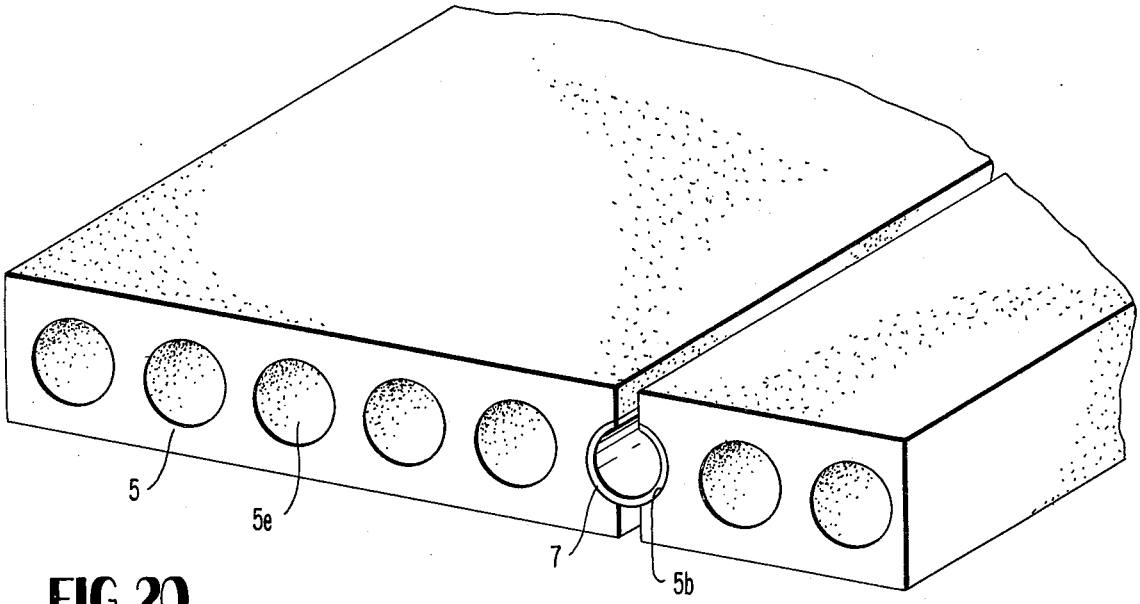
Figure 21:
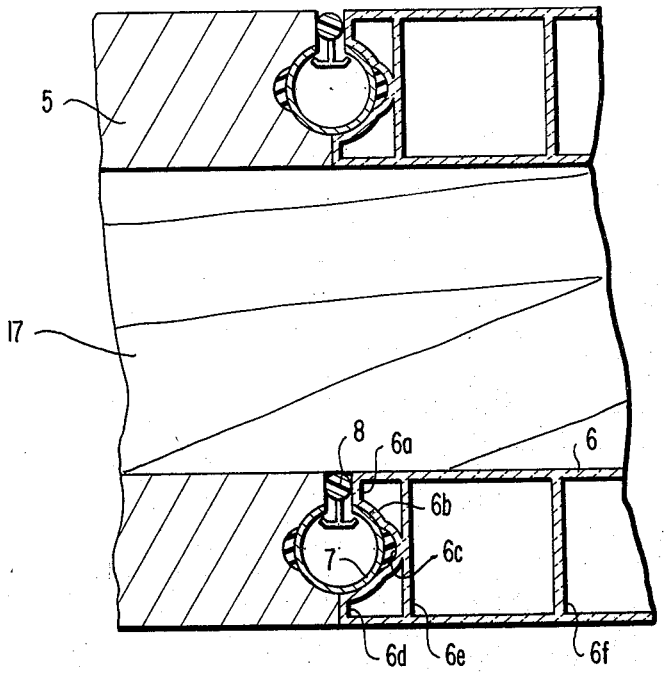

FIGS. 13 and 14 are vertical and horizontal sections, respectively, through the connection of a lighting strip with the partition arrangement of the present invention;

FIGS. 15 and 16 are cross sectional views of a room connnection of the partition arrangement of the present invention with a modified connecting strip;

FIG. 17 is a perspective sectional view of a modified two-wall or two-panel construction in accordance with the present invention;

FIG. 18 is an exploded view of the tubular coupling member of FIG. 17;

FIG. 19 is a cross sectional view illustrating an assembly of the partition arrangement according to FIG. 17;

FIG. 20 is a perspective view of a profiled wall element according to the present invention; and FIG. 21 is a partial cross sectional view of the connection of a transparent, hollow-profile plastic panel employed as a lighting strip in the partition arrangement of the present invention.

Referring now to the drawing wherein like reference numerals are used throughout the various views to designate like parts, and more particularly to FIGS. 1 and 2 wherein portions of the outer shell of the partition arrangement are shown with the outer wall elements or panels 5 being connected to form the partition arrangement by way of tubular coupling members 7.

According to FIG. 1(*a*), the tubular coupling member consists of a smooth tube, for example, of metal or the like, which is guided in recesses or cutouts 5*b* extending along the front edges of the panel 5. As can be seen from FIG. 1(*a*), a butt joint 23 remains as a relatively narrow hairline seam.

As shown in FIG. 1(*b*), a tubular coupling member 7*b* may be provided having a continuous longitudinal slot 7*a* to provide a certain springy resiliency which, in certain cases, facilitates the installation of the panel or wall elements 5. Moreover, one of the longitudinal edges 5a on the end face of the wall element 5 is set back as compared to the other longitudinal edge 5*b* on the other end face of the wall or panel element 5 so that when the wall or panel elements are assembled, a hairline seam 23 remains on one side and a wide butt joint 24 is formed on the other side. Depending upon the orientation of the wall or panel elements 5, the wide butt joint 24 may either face the room or the interior of the partition arrangement.

The tubular coupling member *7c'* illustrated in FIG. 1*c*, as contrasted to the coupling member *7b* of FIG. 1*b*, is provided with an inwardly bent web or tongue *7c'* in the zone of the longitudinal slot *7a*. This type of tubular coupling member construction has the advantage of a higher rigidity. Moreover, the vibrating ability of the coupling member *7c* is reduced which is advantageous in achieving a desired sound attenuation. To improve the sound absorbing characteristics of the arrangement of FIG. 1(*c*) a synthetic resin seal 22 may be inserted in the longitudinal slot *7a*. Furthermore, it is also possible to provide the embodiment shown in FIG. 1(*b*) with a synthetic resin seal to improve the sound absorbing characteristics thereof.

Additionally, in the embodiment of FIG. 1(*c*), the front edges of both walls or panel elements 5 abutting the tubular coupling member *7c'* are set back so that a wide butt joint 24 is produced on both sides of the tubular coupling member *7c.'*

As shown in FIG. 1(*d*), a tubular coupling member *7d* may be provided having a substantially oval cross section.

In a further modification, a tubular coupling member *7f* is provided having a pair of substantially dovetailed recesses *7f'* provided therein in alignment with the wide butt joint 24.

As shown in FIG. 1(*g*), the substantially oval tubular coupling member *7g* is provided with inwardly bent lugs or tongues *7g'* and a recessed portion *7g''* with a synthetic resin seal 22 being disposed between the lugs or tongues *7g'* and within the recessed portion *7g''* to improve the sound absorbing characteristics of the partition arrangement.

In FIG. 1(*h*), a tubular coupling member *7h* is provided which has the shape of a curvilinear square. The front edges of the wall or panel elements 5 are set back by a distance *d* and portions of the tubular coupling member *7h* are received in recesses 5*b* whereby wide butt joints 24 are produced. The butt joints 24 may be covered with decorative moldings or the like or can be fashioned immediately as a partition intersection or crossing point.

In FIG. 1(*i*), a partition intersection is illustrated with a tubular coupling member 7 and with wall or panel elements 5 being strongly set back in the zone of the front edges on both sides of the elements 5 with each of the elements 5 being provided with recesses 5*b* for receiving the tubular coupling member 7.

As shown in FIGS. 2(*a*) and 2(*b*), the tubular coupling members 7 may be provided with slots *7c* at selected intervals which can be used to suspend hinge leaves or plates 25, hooks 26 or the like as shown in FIG. 2(*c*) wherein a hinge plate 25 having mounted thereon an attachment 27 is disposed within a slot *7c* of a tubular coupling member 7.

Figure 3:
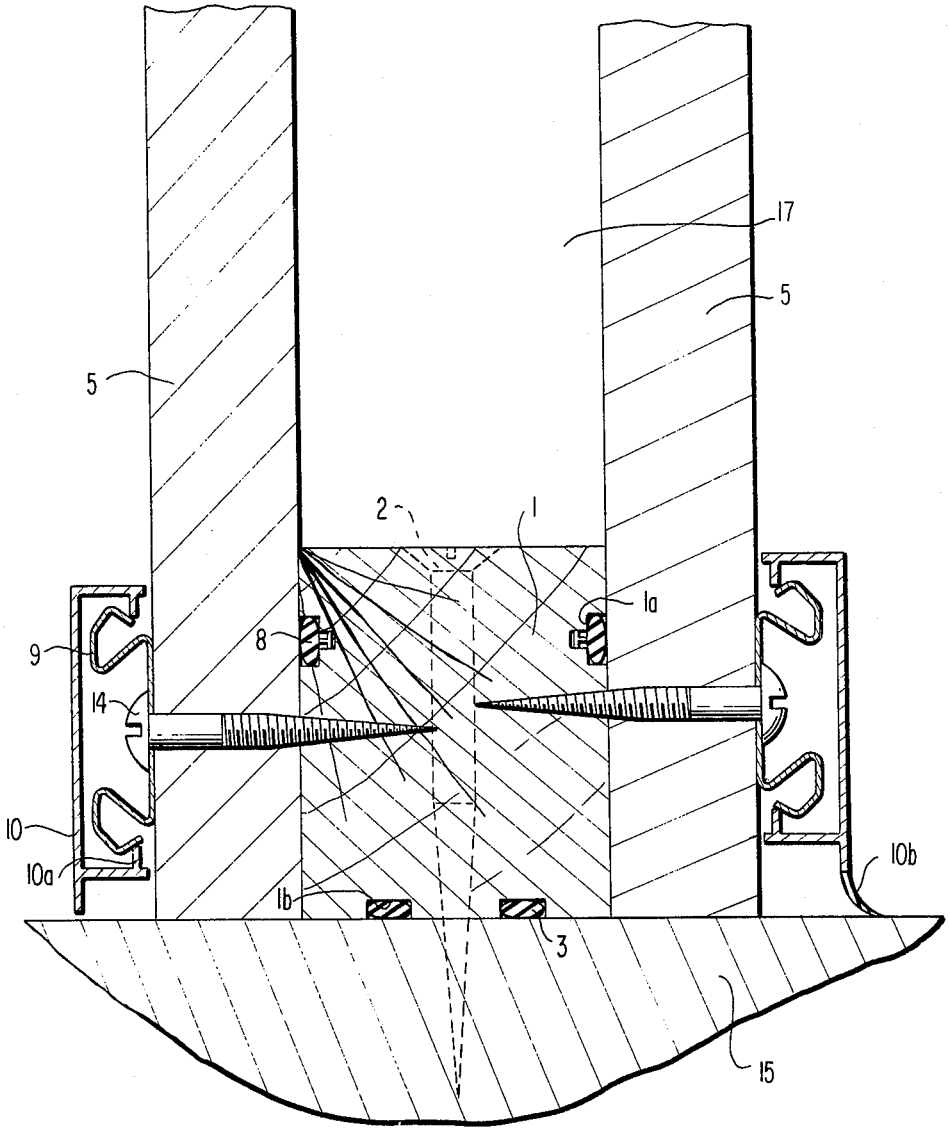
FIG. 3 is a partial cross sectional view through the floor connection of the partition arrangement according to the present invention.

FIG. 3 provides an example of the partition arrangement of the present invention connected to the floor or support surface 15 of a room. As shown in FIG. 3, a connecting strip 1 is provided which can, for example, be made solidly of wood. The side of the connecting strip 1 contacting the floor or support surface 15 is provided with recesses 1*b*; whereas, on the sides contacting the wall or panel elements 5, recesses 1*a* are provided. While FIG. 3 illustrates the recesses 1*a*, 1*b* as having different configurations, it is also possible to form the recesses 1*a*,1*b* to be identical in their cross-sectional shapes. The recesses 1*a*, 1*b* serve for the insertion of permanently elastic sealing means 3 and/or synthetic resin gaskets 8 to attain a tighter and more sound-insulating connection of the partition arrangement. Additionally, dimensional inaccuracies are compensated for by the interposed elastic sealing means 3 or 8.

As further shown in FIG. 3, the connection strip 1 is attached to the floor or support surface 15 of the room, for example, by means of screws 2 or the like. After the wall of panel elements 5 have been set up and attached to the connecting strip by means of screws 14 of the like, a baseboard 10 can be provided as a floor termination. A resilient clip 9 is provided and mounted on the respective panel or wall elements 5 by the screws 14. The baseboard 10 is provided with tongues 10*a* with correspond to the profiled shape of the clip 9 whereby the baseboard 10 may be snap mounted over the clip 9. Additionally, the baseboard 10 can be equipped with a flexible terminal section 10*b* in the zone of the floor or support surface 15 whereby a firm contact with the floor or support surface is provided. As will be apparent from the description set forth hereinbelow, the interstice may be provided with a sound absorbing mat or installation to improve the sound-insulating characteristics of the partition arrangement.

Figure 4:
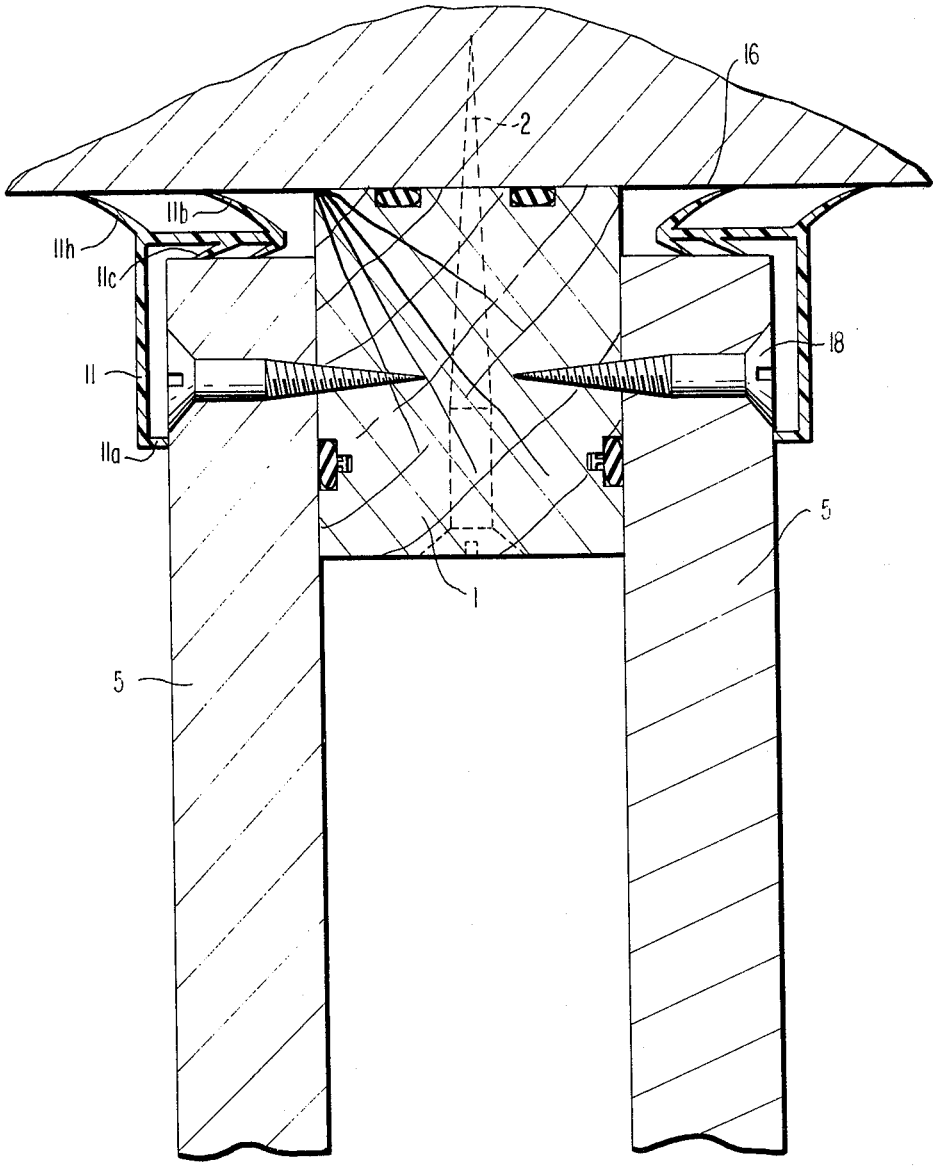
FIG. 4 is a partial cross sectional view through a ceiling connection of the partition arrangement according to the present invention.

FIG. 4 provides an example of the manner of attaching or coupling the partition arrangement of the present invention to a ceiling 16 or the like. As shown in FIG. 4, a connecting strip 1 is employed for connecting the walls or elements 5 to each other and through the ceiling 16. As evident from FIG. 4, the connecting strip 1 is of the same configuration as the connecting strip employed for connecting the partition arrangement with the floor or support surface 15 of the room. After the wall or panel elements 5 are set up, they are attached to the connecting strip 1 by means of screws 18 or the like. By removing the screws 18, a relatively easy and rapid disassembly is made possible at any time. While the wall or panel elements 5 may extend up to the ceiling, it is not absolutely necessary since any remaining gap can be bridged by means of a ceiling strip 11.

The ceiling strip 11 is formed so that it may merely be pressed into place with its shape advantageously approximating a right angle having one leg located between the upper edge of the wall or panel element 5 and the ceiling upon which leg is formed, toward the ceiling 16, with soft sealing lips 11*b* which serve as a height adjustment. Additionally, rigid ribs 11*c* are provided and extend toward the wall or panel element 5 which ribs serve for holding purposes of the ceiling strip 11. The other leg of the ceiling strip 11 is fashioned, at its end, with a projecting rim 11*a* which serves for covering the screws 18 of the like by overlapping the same. Advantageously, the ceiling strip 11 is manufactured as an extruded synthetic resin profile element; however, it is understood that the ceiling strip 11 may be manufactured of any other suitable material.

Figure 5:
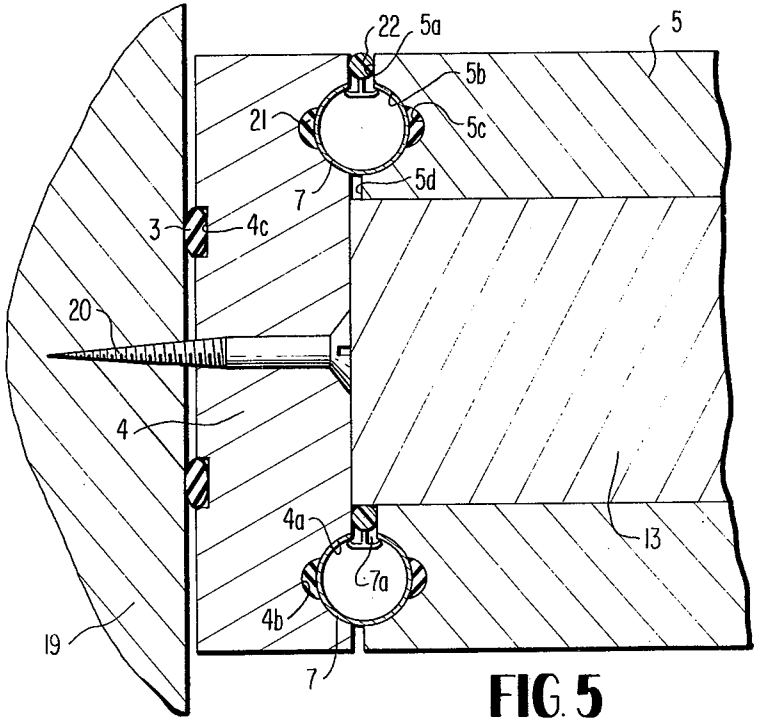
FIG. 5 is a partial cross sectional view through a lateral wall connection of the partition arrangement in accordance with the present invention.

The connection or coupling of the partition arrangement of the present invention to a wall 19 of a room is shown in FIG. 5. As shown in this Figure, a wall connecting strip 4 is provided the width of which corresponds to the thickness of a two-wall or two-panel partition. The wall connecting strip 4 is removably secured to the wall 19 by means of screws 20 or the like on the side of the connecting strip for contacting the wall 19, recesses 4c are provided for the insertion of a permanently elastic sealing means 3 thereby providing a tight and sound-damping connection. On the opposite side of the connecting strip 4, recesses 4a, corresponding to recesses 5b, are provided for the introduction of the tubular coupling members. The recess 4a, which extends through the length of the wall connecting strip 4, is provided centrally with a further concavity or recess 4b. The recess 4b receives a permanently elastic sealing means 21 which produces a sealing function by deformation.

The wall or panel elements 5 forming the outer shell of the partition arrangement, in order to give the outer surface a flush appearance, are provided with continuous recesses 5b along the vertical front edges thereof. The recesses 5b serve for the reception and guidance of the tubular coupling members. The recess 5b is furthermore formed with an additional concavity or recess 5c into which a permanently elastic sealing means 21 can be introduced for sealing purposes and for additional sound attenuation. As indicated hereinabove, the tubular coupling member 7 can be provided with slots, for example, and a sealing means for closing the butt joint and for sound absorption can be disposed in the continuous longitudinal slot 5a.

Sound-absorbing mats 13, installations, or the like can be accommodated, for example, in the remaining free space or interstice between the two wall or panel elements 5 forming the partition arrangement.

Figure 6:
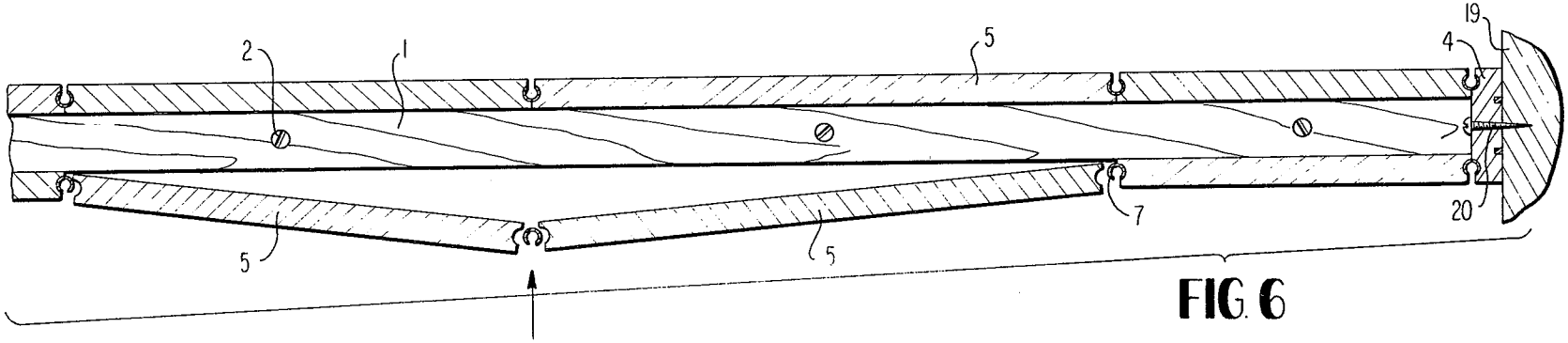
FIG. 6 is a cross sectional view illustrating an assembly step for erecting the partition arrangement of the present invention.

The mounting of the two-wall or two-panel partition arrangement according to the invention is illustrated in FIG. 6. As apparent from this Figure, the first step is the attachment of the connecting strips 1 on the floor, on the ceiling, and the mounting wall connecting strip 4. These connecting strips 1, 4 may be fastened by conventional fastening means; however, as shown in FIG. 6, screws 2, 20 or the like are employed whereby the partition arrangement can readily be disassembled again at any time. Thereafter, the wall or panel elements 5 are set up and are pressed in the direction of the arrow in FIG. 6 flush into place, for example, in pairs in the remaining vacant area with an obliquely oriented tubular coupling member 7 by a turning motion. Subsequently, the wall or panel elements 5 are then attached by means of screws or the like to the floor and ceiling connecting strips 1. Additionally, a mounting or stop plate (not shown) may be provided on the floor and ceiling connecting strip so that the wall or panel elements 5 may be inserted in pairs under tension.

Figure 8:
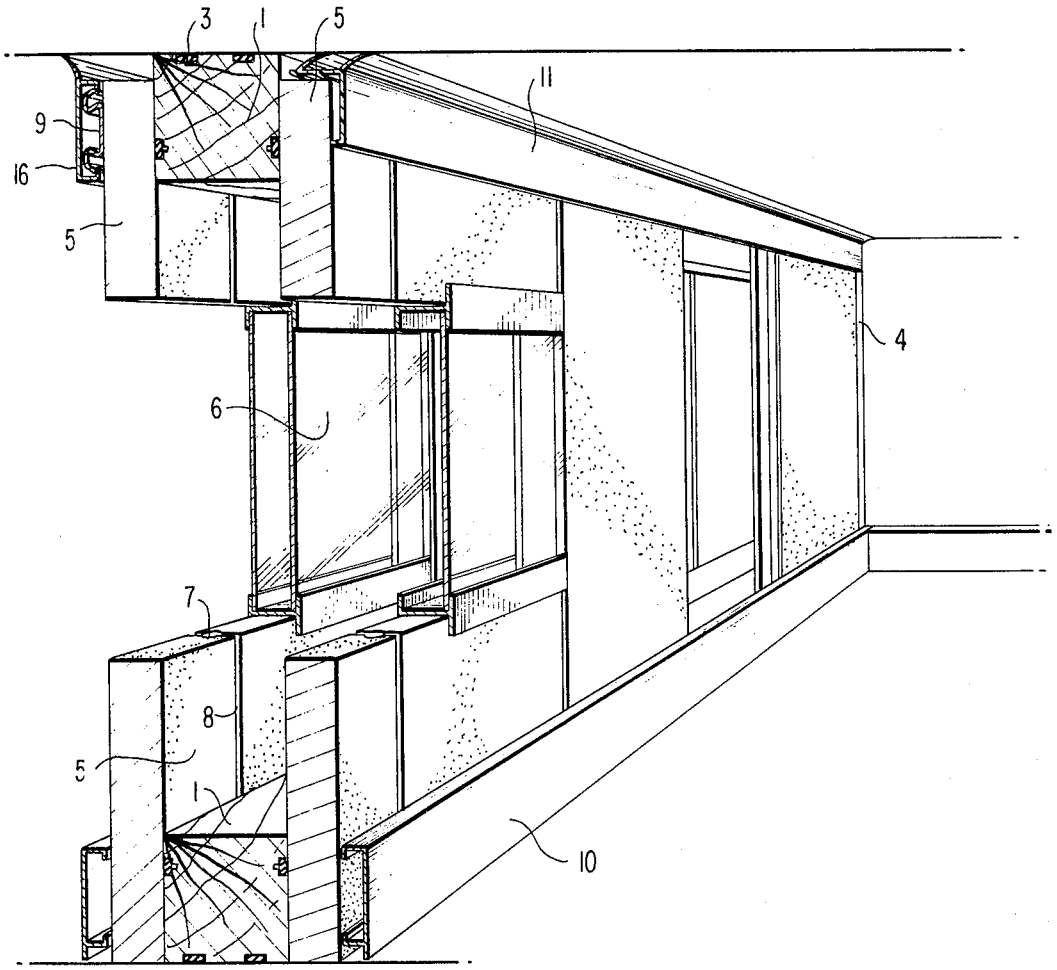
FIG. 8 is a perspective cross sectional view of a two-wall or two-panel partition arrangement of the present invention with additional installations.

FIG. 8 illustrates an assembly of a two-wall or two-panel arrangement according to the present invention which is utilized as a room divider. The partition arrangement includes preferably standardized wall or panel elements 5 which, for example, may consist of chipboards with any desired top coating or synthetic resin panels, or the like. The top coating is provided on the outside of the wall or panel elements 5 in the form of a paint, a coating, a veneer, wallpaper, or the like, with the thickness of the coating having no effect on the assembly of the partition arrangement.

As further shown in FIG. 8, the set-up partition has the connecting strips 1 disposed on the floor and the ceiling with the two-wall or panel elements 5 contacting these parts of the room and being attached thereto. The wall or panel elements 5 are combined with other wall or panel elements 5 by way of coupling members 7. In the floor zone, the baseboards 10 are additionally provided while the ceiling strip 11 forms the termination in the ceiling zone. At the room walls, the wall or panel elements 5 are guided in a wall connection strip 4.

Additionally, as shown in FIG. 8, the partition arrangement can additionally be equipped, as necessary, with light strips 6, doors, windows, etc. As apparent from this Figure, the structure of the partition arrangement of the present invention may be readily assembled in accordance with the building block principle whereby the combination of materials, such as wood, metal, plastics or the like are possible.

Figure 7:
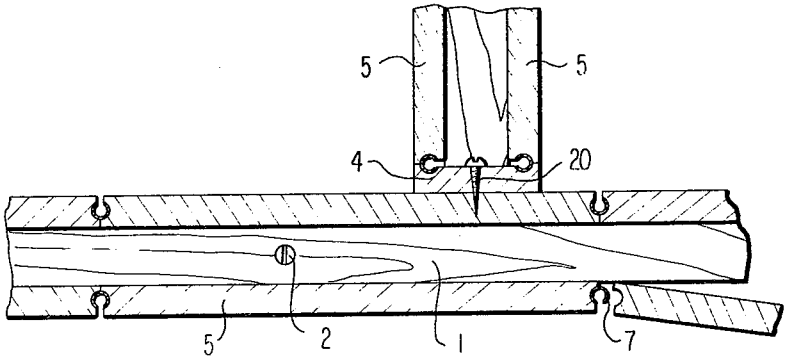
FIG. 7 is a partial cross sectional view of the partition arrangement of the present invention with a lateral branch attached thereto.

FIG. 7 provides an example of a lateral wall connection to the partition arrangement of the present invention which is effected by employing a wall connecting strip 4 secured to one of the wall of panel elements 5 by means of a screw 20 or the like.

Figure 9:
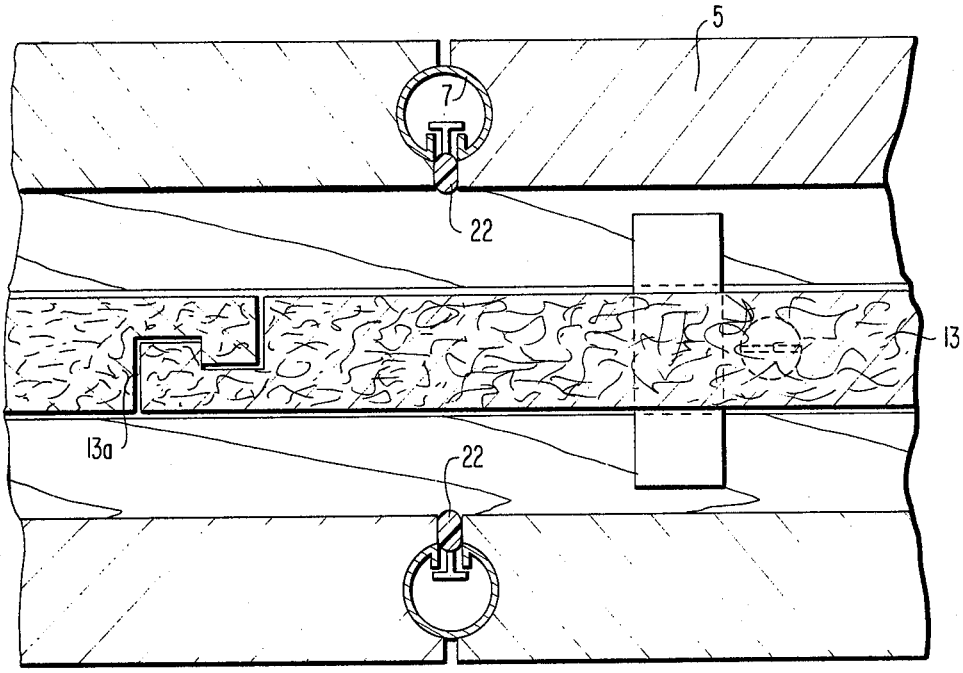
FIGS. 9 and 10 are partial cross sectional views through a two-wall or two-panel partition arrangement provided with sound-damping installations in accordance with the present invention.
Figure 10:
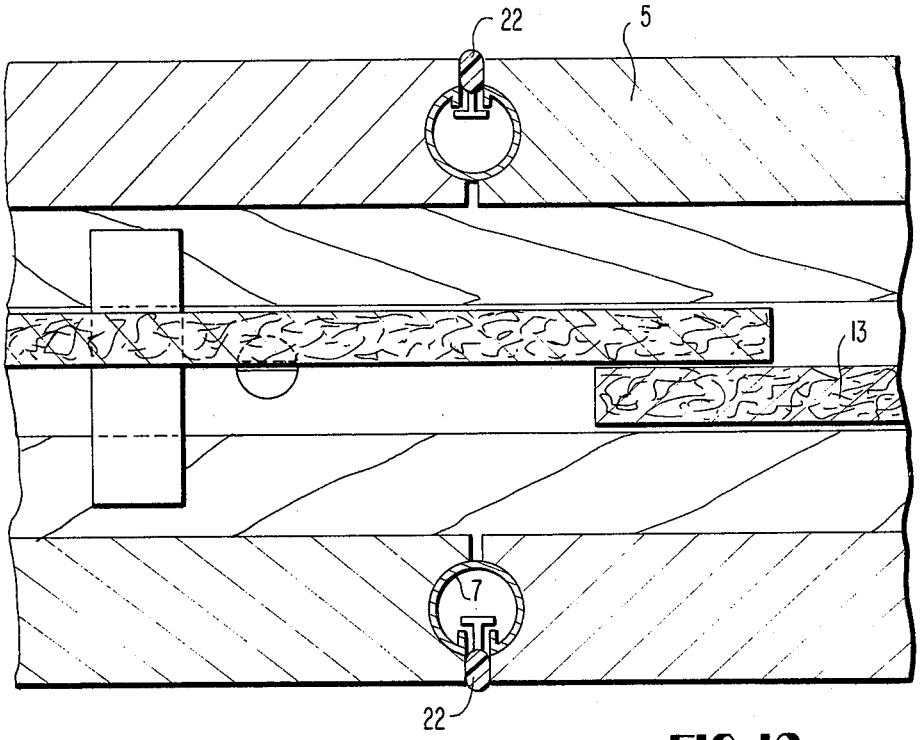

As shown in FIGS. 9 and 10, sound-attenuating materials 13 can be installed in the free space or interstice between the wall or panel elements 5 and, depending on the particular requirements, stronger or weaker sound-absorbing mats can be used which may be joined together by flanges 13a or screws (not shown). The wall or panel elements 5 are differently recessed on their vertical front edges so that a narrow butt joint is produced on one side and a wider butt joint is produced on the other side and, depending on how the wall elements are positioned, and depending on the requirements, the narrow butt joint or the wide butt joint appears visible on the partition arrangement and can be closed, for example, by a synthetic resin seal 22.

As shown in FIGS. 11(*a*) to 11(*c*) windows or the like can be installed by means of frame sections 28 connecting the wall or panel elements 5. The frame sections 28 are provided with a protrusion or projecting surface portion 28a the width of which corresponds to the width of the free space between the wall or panel elements 5. Tubular coupling members are employed for connecting the individual wall or panel elements 5 and the window panes with one another.

As shown in FIG. 11(*c*), smaller panel or wall elements 5' may be provided and disposed between panel or wall elements 5 with the tubular coupling members being employed to couple the respective edges of the panel or wall elements, 5, 5'.

The mounting of the partition arrangement of FIG. 11(*c*) is illustrated in dashed lines in FIG. 11(*c*). As indicated in this Figure, a smaller panel or wall element 5' is disposed between adjacent edges of a pair of panel or wall elements 5 with tubular coupling members 7 being disposed within the recesses provided in the adjacent edges of the wall or panel elements 5, 5'. The wall or panel elements 5, 5' are pressed flush into the full line position and are maintained in said position under tension.

FIGS. 12(*a*)–12(*c*) provide an illustration of the installation of windows or doors in the partition arrangement of the present invention wherein the outer wall obtains its flush or smooth surface in the zone of the frame sections 28 by employing a pair of wall elements 5'' which are interconnected with each other in adjacent frame sections 28 by way of tubular coupling members 7. As indicated in FIG. 12(*c*), by pressing on the wall elements 5'' in the direction of arrow 30 these elements will be displaced inward and maintain in the inward position under tension.

FIGS. 13 and 14 provide an illustrative example of the installation of lighting strips in a two-wall or two-panel partition arrangement with the element connecting the wall or panel elements 5 being fashioned as an H-shaped element 31.

As shown in FIG. 13, a lighting strip 33 is disposed between adjacent wall or panel elements 5 which lighting strip is narrower than the width of the respective wall or panel elements 5. The H-shaped element extends on the one side around the wall element and forms, on the other side, with projecting tongues 31' an insert for sealing means 32 wherein the light strip 33 is held.

In FIG. 14, the lighting strip 33 is also held by an H-shaped element 31 which is provided with an elastic material 34 on its side open toward a tubular coupling member 7 thereby making it possible to form a closed surface during the assembly of the partition in the same manner as for the remaining wall or panel elements 5.

As shown in FIGS. 15 and 16, connecting strips 1' may be provided for connecting the partition arrangement to the ceiling, floor, and wall of a room which connecting strips are fashioned in the form of a U-shaped hollow profile which may be, for example, of a light metal. The connecting strip 1' is formed with recesses 1*a*, 1*b*, 1*h*, for receiving sealing means 3, 8 on the sides contacting the floor, ceiling, and wall or panel elements 5. Additionally, the connecting strip 1' is provided with inwardly bent flanges or tongues 1*c* which define therebetween an opening 1*d* for receiving a sound-attenuating mat 13.

Additionally, a ceiling strip 11 may be provided which has the shape approximately of a right angle with the leg located between the upper edge of the wall or panel element 5 and the ceiling being formed on one side with soft sealing lips 11*b* on the other side with a serration 11*d* extending toward the wall or panel element to hold the ceiling strip 11 in place.

The connecting strip 1' is constructed to be identical for connection to the ceiling, floor, and side wall of the room and the fixation of the wall or panel elements 5 to the side wall, for example, as shown in FIG. 6, can also be effected from the inside by means of profiled metal sheets and screws 36 or the like as shown in FIG. 16. The remaining structure of the embodiment illustrated in FIGS. 15 and 16 corresponds to the construction of the partition arrangement described hereinabove.

FIGS. 17–19 provide an illustrative example of the construction of a partition arrangement in a single-shell fashion specifically, as shown in FIG. 17, connecting strips 1 are provided with tubular coupling members 7 being disposed at selected intervals therealong with the tubular coupling members 7 being joined in pairs alternatingly by means of coupling webs or tongues 7*b* whereby a higher stability is attained, particularly in cases of very high walls.

FIG. 20 provides an illustrative example of a wall element in accordance with the present invention fashioned as a hollow profile panel which is provided with continuous bores 5*e* which result, upon separation, in recesses 5*b* being formed for the reception of tubular coupling members.

In lieu of lighting strip 33 and an H-shaped element 31 as described in connection with the embodiment of FIGS. 13 and 14, according to the present invention, it is possible to insert a completely transparent synthetic-resin profile panel 6 as shown in FIG. 21. In this embodiment, in place of a wall or panel element 5, the transparent plastic profile panel is inserted in the desired area which is constructed with a recess 6*b* for receiving a tubular coupling member along the end faces at the vertical butt joints. Additional concavities or recesses 6*c* are provided for the reception of elastic sealing means. Intermediate webs 6*e*, 6*f* are provided and serve for reinforcing the profiled panel 6. The end face edges 6*a*, 6*d* are off set with respect to each other to obtain a wide seam for the introduction of a plastic seal 8. Consequently, with a transparent synthetic resin profile panel 6 of such construction, no window elements are required which must be mounted by means of supplemental profile means.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are encompassed by the scope of the appended claims.

I claim:

1. A partition arrangement for use in a room, the arrangement comprising: a plurality of wall elements each having a pair of spaced lateral edges, each of said lateral edges being provided with a recess extending along the entire length thereof, mounting means for mounting said plurality of walls on a floor, lateral walls and a ceiling of the room, tubular coupling means disposed in said recesses for coupling adjacent wall elements to each other in tension, said tubular coupling means including a tubular member arranged within said recesses so as to be completely independent of said mounting means and freely movable at least in directions toward and away from the floor and ceiling mounting means during an assembly and disassembly of the plurality of wall elements, said means for mounting said plurality of wall elements to the floor, lateral walls and ceiling of the room consists of a substantially U-shaped profile means, and wherein the partition arrangement is a double-wall partition arrangement, means are provided for fixedly securing each of a plurality of said wall elements to respective leg portions of each of said U-shaped profile means when said plurality of walls are in assembled condition wherein said means for securing said plurality of wall elements to said U-shaped profile means includes a profile metal sheet, said arrangement also including a baseboard means, and means for releasably securing said baseboard means to each of said wall elements along a lower edge thereof, wherein the height of each of said wall elements is less than the height of the room, and wherein a ceiling strip means is disposed between the ceiling of the room and an upper edge of the wall elements, said ceiling strip including a first surface portion extending between the upper edge of the wall elements and the ceiling and a second surface portion extending at substantially a right angle to said first surface portion, said first surface portion on one side thereof facing the ceiling being provided with at least one sealing lip contacting the ceiling of the room and on the other side thereof being provided with a rub means for maintaining said ceiling strip in position.

2. An arrangement according to claim 1, wherein said U-shaped profile means and said plurality of wall elements define an interior space in the double-wall partition arrangement, and wherein sound deadening means are disposed within said interior space.

3. A partition arrangement for use in a room, the arrangement comprising: a plurality of wall elements each having a pair of spaced lateral edges, each of said lateral edges being provided with a recess extending along the entire length thereof, mounting means for mounting said plurality of walls on a floor, lateral walls and a ceiling of the room, tubular coupling means disposed in said recesses for coupling adjacent wall elements to each other in tension, said tubular coupling means including a tubular member arranged within said recesses so as to be completely independent of said mounting means and freely movable at least in directions toward and away from the floor and ceiling mounting means during an assembly and disassembly of the plurality of wall elements, said means for mounting said plurality of wall elements to the floor, lateral walls and ceiling of the room consists of a substantially U-shaped profile means, and wherein the partition arrangement is a double-wall partition arrangement, means are provided for fixedly securing each of a plurality of said wall elements to respective leg portions of each of said U-shaped profile means when said plurality of walls are in an assembled condition wherein said means for securing said plurality of wall elements to said U-shaped profile means includes a profile metal sheet, said arrangement also including a baseboard means, and means for releasably securing said baseboard means to each of said wall elements along a lower edge thereof, and wherein each of said wall elements extends the full height of the room.

4. A partition arrangement for use in a room, the arrangement comprising: a plurality of wall elements each having a pair of spaced lateral edges, each of said lateral edges being provided with a recess extending along the entire length thereof, mounting means for mounting said plurality of walls on a floor, lateral walls and a ceiling of the room, tubular coupling means disposed in said recesses for coupling adjacent wall elements to each other in tension, said tubular coupling means including a tubular member arranged within said recesses so as to be completely independent of said mounting means and freely movable at least in directions toward and away from the floor and ceiling mounting means during an assembly and disassembly of the plurality of wall elements, said means for mounting said plurality of wall elements to the floor, lateral walls and ceiling of the room consists of a substantially U-shaped profile means, and wherein the partition arrangement is a double-wall partition arrangement, means are provided for fixedly securing each of a plurality of said wall elements to respective leg portions of each of said U-shaped profile means when said plurality of walls are in an assembled condition and wherein each of the U-shaped profile means includes a web portion connecting the leg portion, said web portions of the respective profile means in contact with the side walls, ceiling and floor of the room, at least one recess means is provided in each of the leg portions and the web portions, and sealing means are accommodated in each of said recess means.

5. An arrangement according to claim 4, wherein two recess means are provided in each web portion for accommodating a sealing means.

6. A partition arrangement for use in a room having spaced side walls, a ceiling and a floor, the arrangement comprising: a plurality of wall elements each having a pair of spaced lateral edges, a first connecting strip for connecting said wall elements to the floor, a second connecting strip provided on each side wall for connecting said wall elements to the side walls of the room, and a third connecting strip for connecting the wall elements to the ceiling of the room, each respective connecting strip including a first surface portion contacting the floor, the side walls and the ceiling of the room respectively, and at least one other surface portion contacting the wall elements, said first, second and third connecting strips forming a common frame element for providing the support of said plurality of wall elements, each of said lateral edges of said wall elements being provided with a recess extending along the entire length thereof, and tubular coupling means disposed in said recesses of adjacent wall elements for coupling adjacent wall elements, said tubular coupling means being mounted in said recesses completely independently of said first and third connecting strips and freely movable relative thereto at least in directions toward and away from the surface portions contacting the wall elements of said first and third connecting strips during an assembly and disassembly of the plurality of wall elements such that said plurality of wall elements are coupled to each other by said tubular coupling means under tension in an assembled condition, wherein each of said connecting strips consists of a substantially U-shaped hollow profile member, and wherein recesses are provided in said profile member for receiving sealing means, wherein means are provided for releasably mounting said second connecting strips to the side walls of the room, wherein the wall elements are attached to each side of said first and third connecting strips and to said second connecting strip to define a doublewall partition arrangement, and wherein the width of said second connecting strip is substantially equal to the width of the partition arrangement, wherein each of said second connecting strips is provided with further recesses disposed on the surface portions thereof contacting the respective side walls of the room and on the surface portions thereof contacting the wall elements, and wherein sealing means are arranged in each of said further recesses, wherein an interior space is defined between the wall elements attached to said connecting strips, and wherein sound deadening means are disposed within said interior space, and wherein the height of said wall elements is less than the height of the room, and wherein a ceiling strip is disposed between the ceiling of the room and an upper edge of the wall elements, said ceiling strip including a first surface portion extending between the upper edge of the wall elements and the ceiling of the room and a second surface portion extending at substantially a right angle to said first surface portion, said first surface portion on the side thereof facing the ceiling being provided with at least one sealing lip contacting the ceiling of the room and on the other side thereof being provided with rib means for maintaining said ceiling strip in position.

* * * * *